US011021769B2

(12) United States Patent
Koschlig et al.

(10) Patent No.: US 11,021,769 B2
(45) Date of Patent: Jun. 1, 2021

(54) MICRO ALLOYED STEEL AND METHOD FOR PRODUCING SAID STEEL

(71) Applicant: VALLOUREC DEUTSCHLAND GmbH, Dusseldorf (DE)

(72) Inventors: Bernhard Koschlig, Dusseldorf (DE); Stephan Scherf, Dusseldorf (DE); Ralf Hojda, Altena (DE); Rodolfo Nirello, Hautmont (FR)

(73) Assignee: VALLOUREC DEUTSCHLAND GmbH, Dusseldorf (DE)

( * ) Notice: Subject to any disclaimer, the term of this patent is extended or adjusted under 35 U.S.C. 154(b) by 171 days.

(21) Appl. No.: 16/314,018

(22) PCT Filed: Jul. 12, 2017

(86) PCT No.: PCT/EP2017/067606
§ 371 (c)(1),
(2) Date: Dec. 28, 2018

(87) PCT Pub. No.: WO2018/011299
PCT Pub. Date: Jan. 18, 2018

(65) Prior Publication Data

US 2019/0323099 A1 Oct. 24, 2019

(30) Foreign Application Priority Data

Jul. 13, 2016 (EP) ..... 16305910

(51) Int. Cl.
*C21D 7/13* (2006.01)
*C22C 38/02* (2006.01)
(Continued)

(52) U.S. Cl.
CPC ..... *C21D 9/085* (2013.01); *C21D 6/002* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2011/0259478 A1 10/2011 Schneider et al.

FOREIGN PATENT DOCUMENTS

CN 100366778 C 2/2008
DE 10 2008 011 856 A1 9/2009
(Continued)

OTHER PUBLICATIONS

English language machine translation of JP-11179407-A to Maeda et al. Generated Aug. 12, 2020. (Year: 2020).*
(Continued)

*Primary Examiner* — Brian D Walck
(74) *Attorney, Agent, or Firm* — Oblon, McClelland, Maier & Neustadt, L.L.P.

(57) ABSTRACT

The invention deals with Steel for seamless pipes comprising the following chemical composition elements in weight percent: 0.04≤C≤ to 0.18, 0.10≤Si≤0.60, 0.80≤Mn≤1.90, P≤0.020, S≤0.01, 0.01≤Al≤0.06, 0.50≤Cu≤1.20, 0.10≤Cr≤0.60, 0.60≤Ni≤1.20, 0.25≤Mo≤0.60, B≤0.005, V≤0.060, Ti≤0.050, 0.010≤Nb≤0.050, 0.10≤W≤0.50, N≤0.012, where the balance is Fe and inevitable impurities. The steel of the invention can be used in offshore applications, line process pipes, structural and mechanical applications, especially where harsh environmental conditions and service temperatures down to −80° C. occur.

20 Claims, 1 Drawing Sheet

Figure 1:
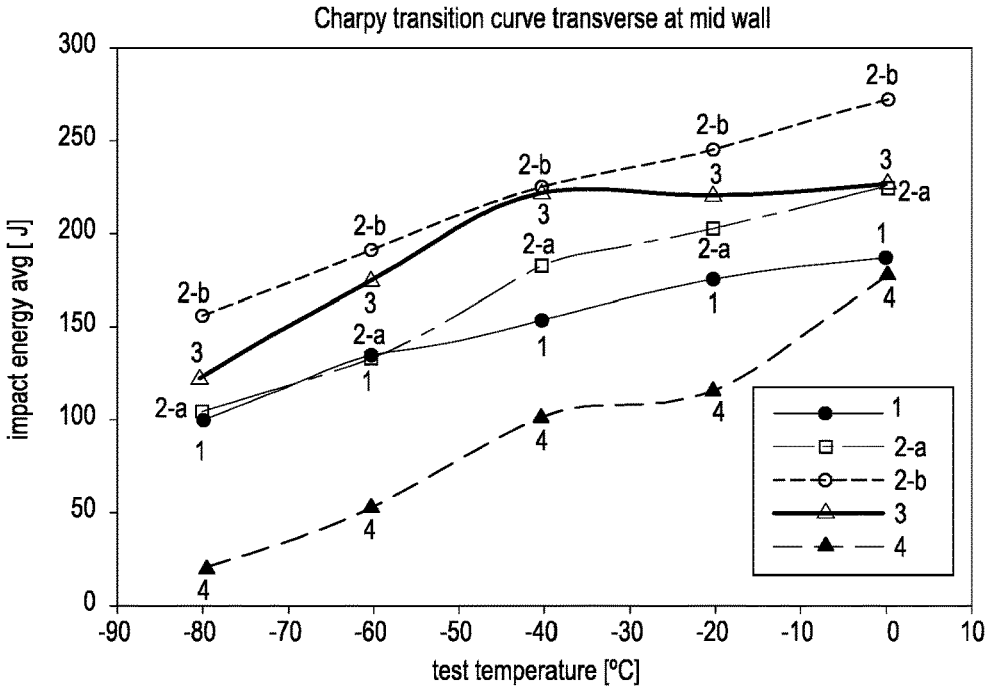

(51) Int. Cl.

| | |
|---|---|
| ***C22C 38/06*** | (2006.01) |
| ***C22C 38/20*** | (2006.01) |
| ***C22C 38/38*** | (2006.01) |
| ***C21D 9/08*** | (2006.01) |
| ***C21D 6/00*** | (2006.01) |
| ***C21D 8/10*** | (2006.01) |
| ***C22C 38/00*** | (2006.01) |

(52) U.S. Cl.
CPC ..... *C21D 7/13* (2013.01); *C21D 8/105* (2013.01); *C22C 38/002* (2013.01); *C22C 38/02* (2013.01); *C22C 38/06* (2013.01); *C22C 38/20* (2013.01); *C22C 38/38* (2013.01); *C21D 2211/002* (2013.01); *C21D 2211/008* (2013.01)

(56) References Cited

FOREIGN PATENT DOCUMENTS

| | | | | |
|---|---|---|---|---|
| EP | 1 546 417 | B1 | | 4/2012 |
| JP | 11179407 | A | * | 7/1999 |

OTHER PUBLICATIONS

International Search Report dated Aug. 25, 2017 in PCT/EP2017/067606 filed on Jul. 12, 2017.

* cited by examiner

MICRO ALLOYED STEEL AND METHOD FOR PRODUCING SAID STEEL

The invention relates to micro alloyed/alloyed steels with yield strength of at least 485 MPa (70 ksi) with outstanding toughness behavior and good weldability, preferably, the invention relates to a steel which has more than 690 MPa (100 ksi). The steel of the invention can be used in offshore applications, line process pipes, structural and mechanical applications, especially where harsh environmental conditions and service temperatures down to −80° C. occur, like in various modern offshore rig designs, e.g. in jack-up rigs as bracing pipes for the open-truss legs as well as in construction equipment as hydraulic cylinder.

Generally speaking, during the past years, pipe manufacturers have made significant attempts to satisfy the increased requirements for saving material. The efforts were based on increased yield and tensile strengths following the design requirements by reducing the wall thickness without changing the loads.

Alloys, which are typically used for seamless pipes in pipeline-/process applications, are defined for steel grades up to 100 ksi (X100) in form of standards, e.g. API 5L and DNV-OS-F101. For high strength grades with wall thicknesses above 25 mm, those standards provide no information with respect to limit values for the chemical composition. In practice, these steels mentioned in the a.m. standards will not only be used for pipelines, they will be used as well for structural and mechanical applications up to 2 inch wall.

Seamless pipes for offshore structures and equipments in typically wall thickness range between 10 mm and 50 mm are covered by the standards of the classification organisms DNV GL and ABS defining grades up and including to 690 MPa YS minimum with different charpy impact testing temperatures down to −60° C. (class F) inclusive chemical composition.

Modifications of the chemical composition for seamless pipes can be agreed between manufacturer, purchaser and classification societies according to the offshore standard for metallic materials DNVGL-OS-B101 and applicable ABS standards.

In the development of high strength grades, it must be taken into account that those materials should have excellent toughness properties and weldability.

Until now, for seamless standard steel grades such as X70 that imply a minimum yield strength (YS) of 485 MPa and a minimum tensile strength (UTS) of 570 MPa according to API 5L were employed in pipelines, however, there is increased demand for higher strength steels in a strength class up to 100 ksi called X100 with a minimum YS of 690 MPa, and a minimum UTS of 770 MPa.

When such steels are used in offshore construction for supporting the frame structure as open-truss legs in self elevating units for instance, high requirements are to be met regarding their weldability i.e. pipe joint welding and their ductility/toughness at low temperatures down to −40° C. and even in the field of arctic even down to −60 to −80° C.

While for welded pipes or plate production the properties targeted for the X100 grades mentioned above could be achieved by a combination of thermo-mechanical rolling with slightly changed chemical composition and heat treatment. Typically the required properties for hot-rolled seamless pipes must be attained using a controlled rolling process followed by quenching and tempering treatment in combination with a well adjusted chemical analysis.

Starting from lower grades, the required increase in strength while maintaining adequate ductility of hot-processed seamless pipes for the afore-described applications requires the development of new alloying concepts. In particular, adequate high ductility with a good weldability is difficult to attain with the conventional alloying concepts/processes for YS above 485 MPa.

Typically known methods in increasing the strengths are increasing the carbon content, the carbon equivalent by using conventional alloying concepts and/or using micro alloying concepts, based on the process of precipitation hardening.

Micro-alloying elements, such as titanium, niobium and vanadium, are generally speaking, employed to increase the strength. Titanium already partially precipitates at high temperatures in the liquid phase as very coarse titanium nitride. Niobium forms niobium (C,N) precipitates at lower temperatures. With further decreasing temperature in the liquid phase, vanadium accumulates additionally in form of carbo-nitrides, i.e., precipitation of VC-particles, leading to material embrittlement.

However, exceedingly coarse precipitates of these micro-alloying elements frequently negatively affect the ductility. Accordingly, the concentration of these alloying elements is generally limited. In addition, the concentration of carbon and nitrogen required for the formation of the precipitates must be taken into account, making the whole chemical composition definition complex.

Those well known concepts could cause in deteriorating of the ductility/toughness and could also lead to poor weldability, as they are more and more limited in complexity and use as higher the grades.

To overcome these above described limitations, new alloying concepts by using elements which are increasing strengths by solution hardening in combination with micro alloying techniques using precipitation hardening at low carbon contents will create high strength steels with excellent ductility/toughness and weldability.

When it comes to steel concepts for seamless pipes with high carbon contents, the application US 2002/0150497 provides an alloy for weldable seamless steel tubes for structural application, through a hot rolling process and subsequent quenching and tempering that includes 0.12 to 0.25 wt. % C, 0.40 wt. % or less Si, 1.20 to 1.80 wt. % Mn, 0.025 wt. % or less P, 0.010 wt. % or less S, 0.01 to 0.06 wt. % Al, 0.20 to 0.50 wt. % Cr, 0.20 to 0.50 wt. % Mo, 0.03 to 0.10 wt. % V, 0.20 wt. % or less Cu, 0.02 wt. % or less N, 0.30 to 1.00 wt. % W, and the balance iron and incidental impurities, for making high-strength. However, as explained before, at such levels, the seamless steel tube weldability is challenging. In addition, toughness values that can be reached with this concept make it hard to use for applications such as arctic ones where the temperature can be as low as −80° C.

Using the same approach, the application US2011/0315277 relates to a steel alloy for a low alloy steel for producing high-tensile, weldable, hot-rolled seamless steel tubing, in particular construction tubing. The chemical composition (in % by mass) being: 0.15-0.18% C; 0.20-0.40% Si; 1.40-1.60% Mn; max. 0.05% P; max. 0.01% S; >0.50-0.90% Cr; >0.50-0.80% Mo; >0.10-0.15% V; 0.60-1.00% W; 0.0130-0.0220% N; the remainder is made up of iron with production-related impurities; with the optional addition of one or more elements selected from Al, Ni, Nb, Ti, with the provision that the relationship V/N has a value of between 4 and 12 and the Ni content of the steel is not more than 0.40%. As for the preceding application US 2002/0150497, the carbon content of this disclosure makes also the weldability challenging. There still has room for improvement of the toughness values also not suitable for arctic application.

Decreasing the carbon content, application US2011/02594787 discloses a high-strength, weldable steel for pipes with a minimum yield strength of 620 MPa and a tensile strength of at least 690 MPa characterized by the following composition in mass-%: 0.030-0.12% C, 0.020-0.050% Al, max. 0.40% Si, 1.30-2.00% Mn, max. 0.015% P, max. 0.005% S, 0.20-0.60% Ni, 0.10-0.40% Cu, 0.20-0.60% Mo, 0.02-0.10% V, 0.02-0.06% Nb, max. 0.0100% N, and remainder iron with melt-related impurities, wherein a ratio Cu/Ni has a value of less than 1. There is room for improvement of the toughness and for the stability of mechanical properties such as toughness and yield strength through the pipe length and its wall thickness.

The steel according to the invention aims at providing a steel having a YS of at least 485 MPa, preferably at least 690 MPa, such steel being suitable for arctic application i.e. with toughness value of at least 69 J at −60° C., preferably at −80° C. Moreover, the steel of the invention has stable properties throughout the length and wall of the seamless pipe.

To solve such problems, the invention relates to a steel for seamless pipes comprising the following chemical composition elements in weight percent, where the limits are included:

$0.04 \leq C \leq$ to 0.18

$0.10 \leq Si \leq 0.60$ $0.80 \leq Mn \leq 1.90$ $P \leq 0.020$ $S \leq 0.01$ $0.01 \leq Al \leq 0.06$ $0.50 \leq Cu \leq 1.20$ $0.10 \leq Cr \leq 0.60$ $0.60 \leq Ni \leq 1.20$ $0.25 \leq Mo \leq 0.60$ $B \leq 0.005$ $V \leq 0.060$ $Ti \leq 0.050$ $0.010 \leq Nb \leq 0.050$ $0.10 \leq W \leq 0.50$ $N \leq 0.012$ where the balance is Fe and inevitable impurities.

In a preferred embodiment, the steel according to the invention has a carbon content C between 0.04% and 0.12% or even more preferably between 0.05% and 0.08%.

As for the manganese, preferably, its content is between 1.15% and 1.60%.

As for the copper, preferably, its content is between 0.60% and 1%.

As for the molybdenum, preferably, its content is between 0.35% and 0.50%.

As for the titanium, preferably, its content is strictly below 0.010%.

In another preferred embodiment, the steel according to the invention has a tungsten content between 0.10% and 0.30%.

In another preferred embodiment, the steel according to the invention has a V content strictly below 0.008%. In another preferred embodiment, the steel according to the invention has a ratio, in weight percent, of carbon content and manganese content such that: $0.031 \leq C/Mn \leq 0.070$. So as to ensure improved weldability, the steel according to the invention preferably has a chemical composition that satisfies the relation below depending on the carbon content:

$$CE_{IIW} \leq 0.65\% \text{ or } CE_{Pcm} \leq 0.30\%$$

where (in weight percent)

$$CE_{IIW} = C + Mn/6 + (Cr+Mo+V)/5 + (Ni+Cu)/15$$

$$CE_{Pcm} = C + Si/30 + (Mn+Cu+Cr)/20 + Ni/60 + Mo/15 + V/10 + 5B$$

The $CE_{IIW}$ limits apply if C>0.12% and the $CE_{Pcm}$ limits apply if $C \leq 0.12\%$.

In another embodiment of the invention, the steel according to the invention has a microstructure comprising less than 15% of polygonal ferrite and the balance being bainite and tempered martensite. The sum of ferrite, bainite and martensite is 100%.

In a preferred embodiment, the steel according to the invention has a yield strength comprised between 485 MPa and 890 MPa on average, and toughness in Joules at −60° C. of at least 10% of the yield strength. For example, for a steel of 500 MPa of YS, the minimum toughness value should be 50 Joules.

In an even more preferred embodiment, the steel according to the invention has a YS of at least 690 MPa in average and a toughness at −80° C. of at least in average 69 J.

The invention also relates to a method of production of steel for seamless pipe comprising at least the following successive steps:

- a steel having a composition according to the invention is provided,
- then the steel is hot formed at a temperature comprised between 1100° C. and 1280° C. through a hot forming process to obtain a pipe,
- then, the pipe is heated up to an austenitizing temperature AT above or equal to 890° C. and kept at the austenitizing temperature AT during a time comprised between 5 and 30 minutes followed by cooling to the ambient temperature so as to obtain a quenched pipe,
- then, the quenched pipe is heated up and held at a tempering temperature TT comprised between 580° C. and 700° C. and kept at the tempering temperature TT during a tempering time Tt comprised between 20 and 60 minutes followed by cooling to the ambient temperature to obtain a quenched and tempered pipe.

The steel according to the invention or produced according to the invention can be used to obtain a seamless pipe with a wall thickness above 12.5 mm for structural component or line pipe components for either onshore or offshore applications.

In a preferred embodiment, such steel is used to obtain a seamless pipe with a wall thickness above 20 mm for structural, mechanical or line pipe applications either onshore or offshore.

FIG. 1 illustrates the charpy transition curves (Joules) of steels 1 to 4.

Figure 2:
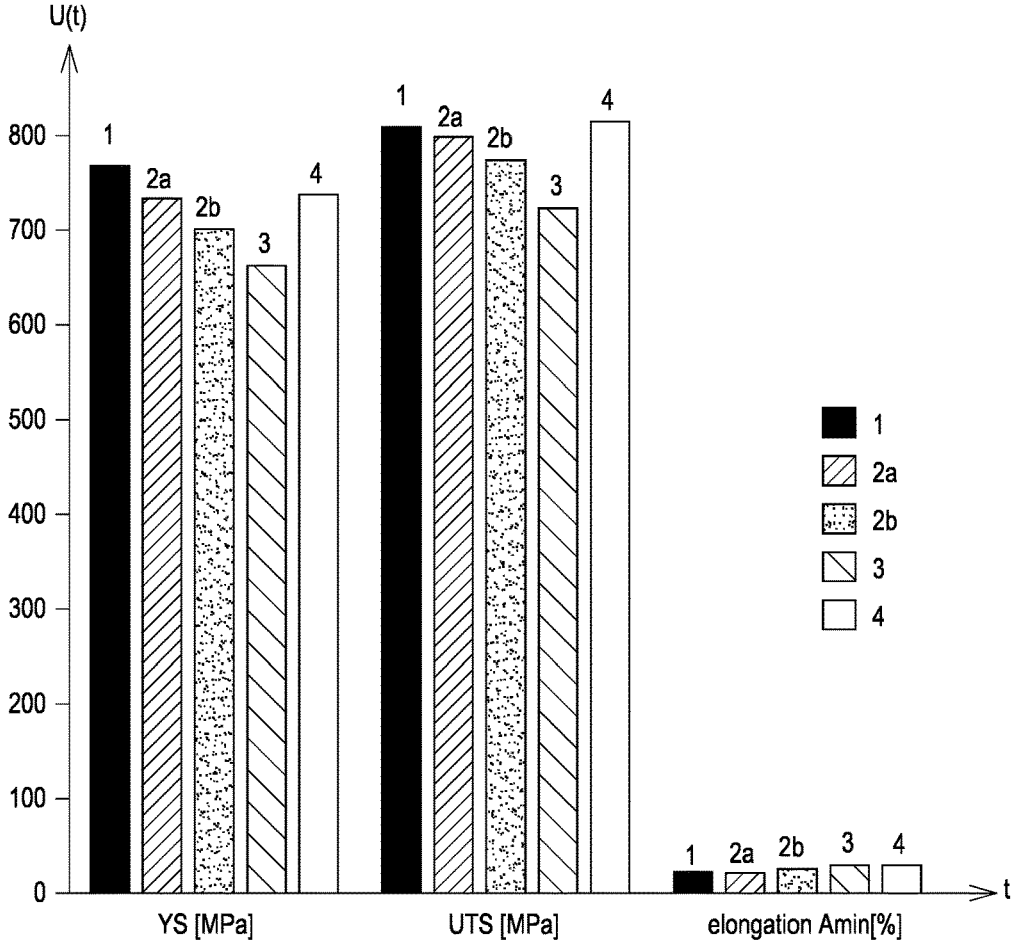

FIG. 2 illustrates the mechanical properties of steel 1 and 2 with tungsten, and 3 and 4 without tungsten.

Also, within the framework of the present invention, the influence of chemical composition elements, preferable microstructural features and production process parameters will be further detailed below.

It is reminded that the chemical composition ranges are expressed in weight percent and include upper and lower limits.

Carbon: 0.04% to 0.18%

Carbon is a strong austenite former that significantly increases the yield strength and the hardness of the steel according to the invention. Below 0.04% the yield strength and the tensile strength decrease significantly and there is a risk to have yield strength below expectations. Above 0.18%, properties such as weldability, ductility and toughness are negatively affected and a classical fully martensite microstructure is reached. Preferably the carbon content is between 0.04 to 0.12%. In an even preferred embodiment, the carbon content is between 0.05 and 0.08%, the limits being included.

Silicon: 0.10% to 0.60%

Silicon is an element which deoxidizes liquid steel. A content of at least 0.10% can produce such an effect. Silicon also increases strength and elongation at levels above 0.10% in the invention. Above 0.60% the toughness of the steel according to the invention is negatively affected, it decreases. To avoid such detrimental effect, the Si content is between 0.10 and 0.60%.

Manganese: 0.80% to 1.90%

Manganese is an element which improves the forgeability and hardenability of steel and it contributes to the steel quenchability. Furthermore, this element is also a strong austenite former which increases the strength of the steel. Consequently, its content should be at a minimum value of 0.80%. Above 1.90%, a decrease in weldability and toughness is expected in the steel according to the invention. Preferably, the Mn content is between 1.15% and 1.60%.

Aluminium: 0.01% to 0.06%

Aluminium is a powerful steel deoxidant and its presence also encourages the desulphurization of steel. It is added in an amount of at least 0.01% in order to have this effect.

However, beyond 0.06%, there is saturation effect with regard to above mentioned effect. In addition, coarse and harmful to ductility Al nitrides tend to be formed. For these reasons, the Al content should be between 0.01 and 0.06%.

Copper: 0.50% to 1.20%

Copper is a very important for solution hardening but this element is known to generally be detrimental to toughness and weldability. In the steel according to the invention, Cu increases both yield strength and tensile strength. In combination with the Ni content of the invention, the loss of toughness and weldability attributed to the Cu presence is ineffective, Ni neutralizes the negative effect of Cu when combined with it in the steel. For this reason, the minimum Cu content should be 0.50%. Above 1.20% the surface quality of the steel according to the invention is negatively impacted by the hot rolling processes. Preferably, the copper content shall between 0.60 and 1%.

Chromium: 0.10% to 0.60%

The presence of Chromium in the steel according to the invention creates chromium precipitates that increase especially the yield strength. For this reason, a minimum Cr content of 0.10% is needed. Above 0.60% the precipitation density effects negatively the toughness and weldability of the steel according to the invention.

Nickel: 0.60% to 1.20%

Nickel is a very important element for solution hardening in the steel of the invention. Ni increases yield strength and tensile strength. In combination with the presence of Cu, it improves the toughness properties. For this reason, its minimum content is 0.60%. Above 1.20% the surface quality of the steel according to the invention is negatively impacted by the hot rolling processes.

Molybdenum: 0.25% to 0.60%

Molybdenum increases both yield and tensile strength and supports the homogeneity of the mechanical properties, the microstructure and the toughness in the base material through the length and thickness of the pipe. Below 0.25% the above described effects are not effective enough. Above 0.60% the steel behavior when it comes to weldability and toughness is negatively impacted. Preferably the Mo content is between 0.35 and 0.50%, limits being included.

Niobium: 0.010% to 0.050%

Niobium presence leads to carbide and/or nitride precipitates leading to a fine grain size microstructure by grain boundary pinning effects. Therefore increase in yield strength is obtained by Hall Petch effect. The homogeneity of grain sizes improves the toughness behavior. For all these effects, a minimum of 0.010% of Nb is needed. Above 0.050%, a strict control of the nitrogen content is needed so as to avoid a brittle effect of NbC. In addition above 0.050%, a decrease of the toughness behavior is expected for the steel according to the invention.

Tungsten: 0.10% to 0.50%

The addition of tungsten is intended to provide to the produced tubes with a stable yield strength i.e. low variation of yield strength up to an operational temperature of 200° C. The addition of tungsten brings also a steady stress-strain relation. Above 0.10%, tungsten also additionally supports the positive effects of molybdenum alloying mentioned above. For this reason a minimum content of 0.10% of tungsten is needed in the steel according to the invention. Above 0.50% of tungsten, the toughness and weldability of the steel according to the invention start to decrease. Preferably, the tungsten content is between 0.10% and 0.30%.

Boron: ≤0.005%

Boron is an impurity in the steel according to the invention. This element is not voluntarily added. Above 0.005% it impacts negatively the weldability because after welding it is expected to create hard spots in the heat infected zone, thus decreasing the weldability of the steel according to the invention.

Vanadium: ≤0.060%

Above 0.060% vanadium precipitates increase the risk of having a scatter in toughness values at low temperatures and/or a shift of transition temperatures to higher temperatures. Consequently, the toughness properties are negatively impacted by vanadium contents above 0.060%. Preferably, the vanadium content is strictly below 0.008%.

Titanium: ≤0.050%

This is an impurity element. It is not voluntarily added in the steel according to the invention. Above 0.050%, carbon and nitrogen precipitates with Ti such as TiN and TiC change the balance of carbide and nitride precipitation with niobium and in consequence the beneficial effects of niobium will be hindered. The yield strength of the steel will be negatively affected, it will decrease. Preferably, the Ti content is below or equal 0.010%.

Nitrogen: ≤0.012%

Above 0.012% big sized nitride precipitations are expected and these precipitates will negatively affect the toughness behavior by changing the transition temperature in the upper range.

Residual Elements

The balance is made of Fe and inevitable impurities resulting from the steel production and casting processes. The contents of main impurity elements are limited as below defined for phosphorus and sulfur:

$P \leq 0.020\%$ $S \leq 0.005\%$

Other elements such as Ca and REM (rare earth minerals) can also be present as unavoidable impurities.

The sum of impurity element contents is lower than 0.1%.

It should be noted that in a preferred embodiment, $0.031 \leq C/Mn \leq 0.070$. This range allows the steel of the invention to be less sensitive to cooling rates most importantly for thick products where the cooling rate modifies significantly the microstructural features. The stability of properties such as toughness and yield strength is better in this range of chemical composition in weight percent.

Method of Production

The method claimed by the invention comprises at least the following successive steps listed below. In this best embodiment, a steel pipe is produced.

A steel having the composition claimed by the invention is obtained according to casting methods known in the art. Then the steel is heated at a temperature between 1100° C. and 1280° C., so that at all points the temperature reached is favorable to the high rates of deformation the steel will undergo during hot forming. This temperature range is needed to be in the austenitic range. Preferably the maximum temperature is lower than 1280° C. The ingot or billet is then hot formed in at least one step with the common worldwide used hot forming processes e.g. forging, pilger process, conti mandrel, premium quality finishing process to a pipe with the desired dimensions.

The minimum deformation ratio shall be at least 3.

The pipe is then austenitized i.e. heated up to a temperature AT where the microstructure is austenitic. The austenitization temperature AT is above Ac3, preferably above 890° C. The pipe made of steel according to the invention is then kept at the austenitization temperature AT for an austenitization time At of at least 5 minutes, the objective being that at all points of the pipe, the temperature reached is at least equal to the austenitization temperature. So as to make sure that the temperature is homogeneous throughout the pipe. The austenitization time At shall not be above 30 minutes because above such duration, the austenite grains grow undesirably large and lead to a coarser final structure. This would be detrimental to toughness.

Then, the pipe made of steel according to the invention is cooled to the ambient temperature, preferably using water quenching. Then, the quenched pipe made of steel according to the invention is preferably tempered i.e. heated and held at a tempering temperature TT comprised between 580° C. and 700° C. Such tempering is done during a tempering time Tt between 20 and 60 minutes. This leads to a quenched and tempered steel pipe.

Finally, the quenched and tempered steel pipe according to the invention is cooled to the ambient temperature using air cooling.

In this manner, a quenched and tempered pipe made of steel is obtained which contains in area less than 15% percentage of polygonal ferrite, the balance is bainitic structure and martensite. The sum of polygonal ferrite, bainite and martensite is 100%.

Microstructural Features

Martensite

The martensite content in the steel according to the invention depends on cooling speed during quenching operation. In combination with the chemical composition it depends on wall thickness and the martensite content is between 5% and 100%. The balance to 100% is polygonal ferrite and bainite.

Polygonal Ferrite

In a preferred embodiment, the quenched and tempered steel pipe according to the invention, after final cooling, presents a microstructure with less than 15% of polygonal ferrite in volume fraction. Ideally, there is no ferrite in the steel since it would impact negatively the YS and UTS of the steel according to the invention.

Bainite

The bainite content in the steel according to the invention depends on cooling speed during quenching operation. In combination with the chemical composition it is limited to a maximum of 80%. The balance to 100% is polygonal ferrite and martensite. A bainite content above 80% leads to low yield strength and tensile strength as well as inhomogeneous properties though the wall thickness.

The invention will be illustrated below on the basis of the following non-limiting examples:

Steels have been prepared and their compositions are presented in the following table 1, expressed in weight percent.

The compositions of steels 1 and 2 are according to the invention.

For the purpose of comparison the composition 3 and 4 are used for the fabrication of the reference steel and are therefore not according to the invention.

TABLE 1

Chemical compositions of examples

| Steel No | C | Si | Mn | P | S | Al | Cu | Cr |
|---|---|---|---|---|---|---|---|---|
| 1 | 0.06 | 0.41 | 1.53 | 0.013 | 0.002 | 0.03 | 0.83 | 0.25 |
| 2 | 0.07 | 0.37 | 1.42 | 0.012 | 0.003 | 0.03 | 0.67 | 0.23 |
| 3 | 0.06 | 0.40 | 1.48 | 0.013 | 0.002 | 0.03 | 0.17 | 0.24 |
| 4 | 0.06 | 0.40 | 1.49 | 0.013 | 0.002 | 0.03 | 0.42 | 0.24 |

| Steel No | Ni | Mo | B | V | Ti | Nb | W | N |
|---|---|---|---|---|---|---|---|---|
| 1 | 0.87 | 0.48 | <0.002 | 0.002 | 0.006 | 0.015 | 0.27 | 0.007 |
| 2 | 0.80 | 0.46 | <0.002 | 0.003 | 0.004 | 0.020 | 0.19 | 0.009 |
| 3 | 0.18 | 0.48 | <0.002 | <0.005 | 0.010 | 0.014 | <0.01 | 0.007 |
| 4 | 0.50 | 0.48 | <0.002 | 0.06 | 0.010 | 0.014 | <0.01 | 0.007 |

Underlined values are not in conformity with the invention.

The upstream process i.e. from melting to hot forming, is done with commonly-known manufacturing method for seamless steel pipes after heating at a temperature between 1150° C. and 1260° C. for hot forming. For example, it is desirable that molten steel of the above constituent composition be melted by commonly-used melting practices. The common methods involved are the continuous or ingot casting process. Next, these materials are heated, and then manufactured into pipe e.g. by hot working by forging, the plug or pilger mill process, which are commonly-known manufacturing methods, of the above constituent composition into the desired dimensions.

The compositions of table 1 have undergone a production process that can be summarized in the table 2 below with:

AT (° C.): Austenitization temperature in ° C.

At: Austenitization time in minutes

The cooling after austenitization is done with water quenching.

TT: Tempering temperature in ° C.

Tt: Tempering time in minutes

The cooling after tempering is an air cooling.

TABLE 2 process conditions of examples after hot rolling

| No | | Heat Treatment AT [° C.] | At [min] | TT [° C.] | Tt [min] | Wall thickness [mm] |
|---|---|---|---|---|---|---|
| 1 | | 930 | 10' | 630 | 60' | 30 |
| 2 | a | 930 | | 630 | 45' | 40 |
| | b | 920 | | 640 | 20' | 27.8 |
| 3 | | 930 | | 630 | 60' | 30 |
| 4 | | 930 | | 630 | 60' | 30 |

The steel references 1 and 2 are according to the invention while reference 3 and 4 are not, in terms of chemical composition. The process parameters are all according to the invention. This led to quenched and tempered steel tubes that, after final cooling from the tempering temperature, present a microstructure comprising less than 15% of ferrite, the balance being bainite and martensite.

The process of table 2 applied to the chemical compositions of table 1 led also to specific mechanical behavior, and toughness values that are summarized in table 3 and 4.

YS, in MPa and ksi, is the yield strength obtained in tensile test as defined in standards ASTM A370 and ASTM E8.

UTS, in MPa and ksi, is the tensile strength obtained in tensile test as defined in standards ASTM A370 and ASTM E8.

TABLE 3

Impact energy results

| | thickness [mm] | T [° C.] | avg [J] transverse | min [J] | max [J] |
|---|---|---|---|---|---|
| Steel N°1 | 30 | 0 | 186 | 170 | 200 |
| | | −20 | 175 | 173 | 177 |
| | | −40 | 154 | 144 | 165 |
| | | −60 | 134 | 120 | 146 |
| | | −80 | 100 | 97 | 105 |
| Steel N°2-a | 40 | 0 | 225 | 210 | 247 |
| | | −20 | 202 | 197 | 208 |
| | | −40 | 182 | 178 | 184 |
| | | −60 | 134 | 130 | 143 |
| | | −80 | 103 | 101 | 106 |
| Steel N°2-b | 27.8 | 0 | 272 | 262 | 282 |
| | | −20 | 246 | 220 | 279 |
| | | −40 | 225 | 220 | 227 |
| | | −60 | 192 | 181 | 194 |
| | | −80 | 155 | 150 | 159 |
| Steel N°3 | 30 | 0 | 227 | 222 | 231 |
| | | −20 | 220 | 212 | 228 |
| | | −40 | 222 | 212 | 234 |
| | | −60 | 176 | 148 | 196 |
| | | −80 | 122 | 116 | 130 |
| Steel N°4 | 30 | 0 | 178 | 160 | 190 |
| | | −20 | 117 | 92 | 114 |
| | | −40 | 101 | 18 | 144 |

TABLE 3-continued

Impact energy results

| | thickness [mm] | T [° C.] | avg [J] transverse | min [J] | max [J] |
|---|---|---|---|---|---|
| | | −60 | 53 | 22 | 102 |
| | | −80 | 19 | 12 | 26 |

The mean impact energy values of the steels according to the invention is equal or above 100 J at −80° C. Steel No. 3 has good charpy values as well but the mechanical properties are too low. Steel 4 has sufficient mechanical properties but the charpy values start to scatter already at −40° C.

TABLE 4

Mechanical properties

| | YS [MPa] | UTS [MPa] | elongation $A_{min}$ [%] |
|---|---|---|---|
| Steel N°1 | 776 | 820 | 22.0 |
| Steel N°2-a | 740 | 806 | 19.9 |
| Steel N°2-b | 707 | 786 | 20.8 |
| Steel N°3 | 667 | 728 | 26.0 |
| Steel N°4 | 747 | 821 | 25.0 |

The steel according to the invention has preferably more than 690 MPa of yield strength and an impact energy average value of at least 100 J at −80° C.

Welding tests have been performed on steel No. 2 by using FCAW process. The results of the charpy tests at −60° C. in the fusion line and heat effected zone are shown in table 5.

TABLE 5

Impact energy at −60° C. for steel N°2-b

| location | Kcv 1 [J] | Kcv 2 [J] | Kcv 3 [J] | Kcv avg [J] |
|---|---|---|---|---|
| FL | 265 | 273 | 269 | 269 |
| FL + 2 | 198 | 198 | 172 | 189 |
| FL + 5 | 224 | 211 | 235 | 223 |

Where FL is the fusion line and FL+X represents distance X in mm away from the fusion line. The impact energy values for the steels with tungsten are even in the welded condition very good and suitable for arctic applications.

The invention claimed is:

1. Steel for seamless pipes, comprising, in weight percent:

0.04≤C≤ to 0.18,
0.10≤Si≤0.60,
0.80≤Mn≤1.90,
P≤0.020,
S≤0.01,
0.01≤Al≤0.06,
0.50≤Cu≤1.20,
0.10≤Cr ≤0.60,
0.60≤Ni≤1.20,
0.25≤Mo≤0.60,
B≤0.005,
V≤0.060,
Ti≤0.010,
0.010≤Nb≤0.050,
0.10≤W≤0.50,
N≤0.012,
Fe and
inevitable impurities.

2. The steel according to claim 1, wherein C is between 0.04% and 0.12%.

3. The steel according to claim 1, wherein C is between 0.05% and 0.08%.

4. The steel according to claim 1, wherein Mn is between 1.15% and 1.60%.

5. The steel according to claim 1, wherein Cu is between 0.60% and 1%.

6. The steel according to claim 1, wherein Mo is between 0.35% and 0.50%.

7. The steel according to claim 1, wherein W is between 0.10% and 0.30%.

8. The steel according to claim 1, wherein V is below 0.008%.

9. The steel according to claim 1, wherein a weight ratio of carbon to manganese satisfies: $0.031 \leq C/Mn \leq 0.070$.

10. The steel according to claim 1, wherein in weight percent:

$$CE_{IIW} \leq 0.65\% \text{ and } CE_{Pcm} \leq 0.30\%$$

where $CE_{IIW}$=C+Mn/6+(Cr+Mo+V)/5+(Ni+Cu)/15 and applies when C>0.12%, and $CE_{Pcm}$=C+Si/30+(Mn+Cu+Cr)/20+Ni/60+Mo/15+V/10+5B and applies when C≤0.12%.

11. The steel according to claim 1, which has a microstructure comprising less than 15% of ferrite, the balance being bainite and martensite.

12. The steel according to claim 1, which has an average yield strength of 550 MPa to 890 MPa, and a toughness in joules at −60° C. of at least 10% of the yield strength.

13. The steel according to claim 1, which has an average yield strength of at least 690 MPa, and an average toughness at −80° C. of at least 69 J.

14. A method of producing a seamless steel pipe, the method comprising:

hot forming the steel according to claim 1 at a temperature of 1100° C. to 1280° C. to obtain a pipe, then, heating the pipe to an austenitizing temperature AT above or equal to 890° C. and keeping the pipe at the austenitizing temperature AT for 5 to 30 minutes followed by cooling the pipe to an ambient temperature to obtain a quenched pipe, and then, heating the quenched pipe to a tempering temperature TT of 580° C. to 700° C. and keeping the pipe at the tempering temperature TT for a tempering time Tt of 20 to 60 minutes followed by cooling the pipe to the ambient temperature to obtain a quenched and tempered pipe.

15. A structural and/or mechanical component, made of the steel according to claim 1.

16. A line pipe component and/or an oil and gas accessory, made of the steel according to claim 1.

17. Steel for seamless pipes, comprising, in weight percent:

0.04≤C≤ to 0.18,
0.10≤Si≤0.60,
0.80≤Mn≤1.90,
P≤0.020,
S≤0.01,
0.01≤Al≤0.06,
0.50≤Cu≤1.20,
0.10≤Cr ≤0.60,
0.60≤Ni≤1.20,
0.25≤Mo≤0.60,
B≤0.005,
V≤0.060,
Ti≤0.050,
0.010≤Nb≤0.050,
0.10≤W≤0.30,
N≤0.012,
Fe and
inevitable impurities.

18. The steel according to claim 17, wherein Ti is below or equal to 0.010%.

19. The steel according to claim 17, wherein C is between 0.04% and 0.12%.

20. The steel according to claim 17, wherein C is between 0.05% and 0.08%.

* * * * *